US007345568B2

(12) United States Patent
Yu

(10) Patent No.: US 7,345,568 B2
(45) Date of Patent: Mar. 18, 2008

(54) DUAL PROTECTION DEVICE FOR CIRCUITS

(76) Inventor: Tsung-Mou Yu, No. 4, Alley 2, Lane 23, Sec. 3, Pa Te Rd., Panchiao, Taipei (TW)

( * ) Notice: Subject to any disclaimer, the term of this patent is extended or adjusted under 35 U.S.C. 154(b) by 381 days.

(21) Appl. No.: 11/121,254

(22) Filed: May 3, 2005

(65) Prior Publication Data

US 2006/0250208 A1 Nov. 9, 2006

(51) Int. Cl.
*H01H 37/12* (2006.01)
*H01H 37/54* (2006.01)

(52) U.S. Cl. ..... 337/142; 337/3; 337/4; 337/13; 337/36; 361/105

(58) Field of Classification Search ..... 337/4, 337/3, 13, 142, 147, 153, 182–184, 206, 337/241–243, 265–267; 361/36, 105
See application file for complete search history.

(56) References Cited

U.S. PATENT DOCUMENTS 4,319,126 A * 3/1982 Lujic ..... 219/512
4,433,231 A * 2/1984 Balchunas ..... 219/253
4,876,523 A * 10/1989 Kushida et al. ..... 337/299
5,196,820 A * 3/1993 Ubukata et al. ..... 337/368
5,221,914 A * 6/1993 Ubukata et al. ..... 337/13
5,684,447 A * 11/1997 Korczynski et al. ..... 337/5
6,091,315 A * 7/2000 Hofsass ..... 337/13
6,191,680 B1 * 2/2001 Hofsass ..... 337/362
6,741,159 B1 * 5/2004 Kuczynski ..... 337/403
7,075,403 B2 * 7/2006 Unno et al. ..... 337/365
7,209,336 B2 * 4/2007 Yu ..... 361/105

* cited by examiner

*Primary Examiner*—Anatoly Vortman

(57) ABSTRACT

A protection device includes a bi-metallic plate having a first end fixed to a first terminal and a second of the bi-metallic plate has a first contact point so as to contact a second contact point on a first end of a carrier. A contact plate has a first end in contact with a second terminal and a second end of the contact plate is forced to connect to a second end of the carrier by a low melting point metal. When the protection device is overloaded, the bi-metallic plate is bent to separate the first contact point and the second contact point. Besides, if the bi-metallic plate does not bend as expected, the low melting point metal melts to separate the second end of the contact plate and the carrier when a pre-set temperature is reached.

3 Claims, 9 Drawing Sheets

(ON)

(ON)

(OFF)

(OFF)

(ON)

(OFF)

(OFF)

DUAL PROTECTION DEVICE FOR CIRCUITS

FIELD OF THE INVENTION

The present invention relates to a dual protection device that includes two independent protections to ensure that the electric appliance will not be damaged when the protection device is overload.

BACKGROUND OF THE INVENTION

A conventional protection device for electric appliance uses fuses which are broken when the fuses are overheated due to overload. After the fuses are broken, the circuit is cut off to prevent the electric appliance from being burned. In the modern design of the electric appliance, several circuits are involved and each circuit has a switch or protection device so as to achieve multiple layers of protection.

As shown in FIG. 1, a latest protection device includes a bi-metallic plate 201 which has a first end fixed to a first terminal 202 and a second end is a free end which has a first contact point 203 connected to an underside thereof. A second contact point 205 is fixed on a second terminal 204 and when the first and second contact points 203, 205 are in contact with each other, the circuit is in "ON" status. When the circuit is overloaded, as shown in FIG. 2, the high temperature makes the bi-metallic plate 201 bend upward so that the first and second contact points 203, 205 are separated and the circuit is in "OFF" status. By this way, the appliance is protected from being burned. However, it is a difficult task to ensure and to manufacture each bi-metallic plate having the same physical characteristics. Some of the bi-metallic plates do not bend at desired temperature and the range of the temperature is too wide to precisely set the bi-metallic plates to have the same characteristics. Furthermore, some bi-metallic plates are not so sensitive to the temperature and do not react as desired. Besides, when the bi-metallic plate bends less than as desired, the small gap between the two contact points might generate sparks to burn the whole appliance.

The present invention intends to provide a dual protection device that includes a bi-metallic plate and a contact plate which is connected to a carrier of one of the contact point by low melting metal which melts at desired temperature to cut off the circuit.

SUMMARY OF THE INVENTION

The present invention relates to a protection device that comprises a bi-metallic plate having a first end fixed to a first terminal and a second end of the bi-metallic plate has a first contact point. A carrier has a second contact point connected on a first end thereof and the second contact point is located beneath the first contact point. A contact plate has a first end in contact with a second terminal and a second end of the contact plate is forced to connect to a second end of the carrier by a low melting point metal. The low melting point metal melts to separate the second end of the contact plate and the carrier when the protection device is overloaded.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
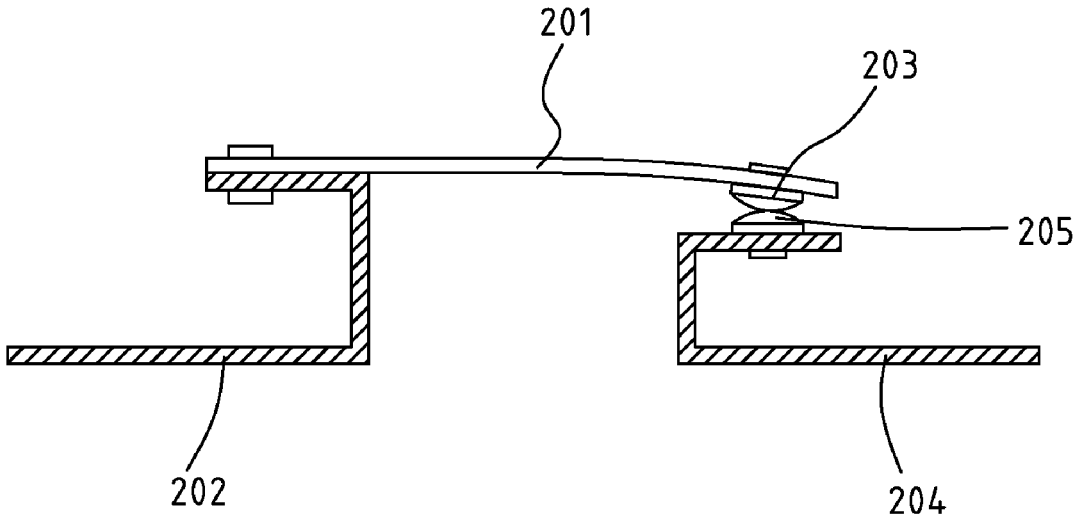
FIG. 1 (PRIOR ART)
FIG. 1 shows a conventional protection device in "ON" status.
Figure 2:
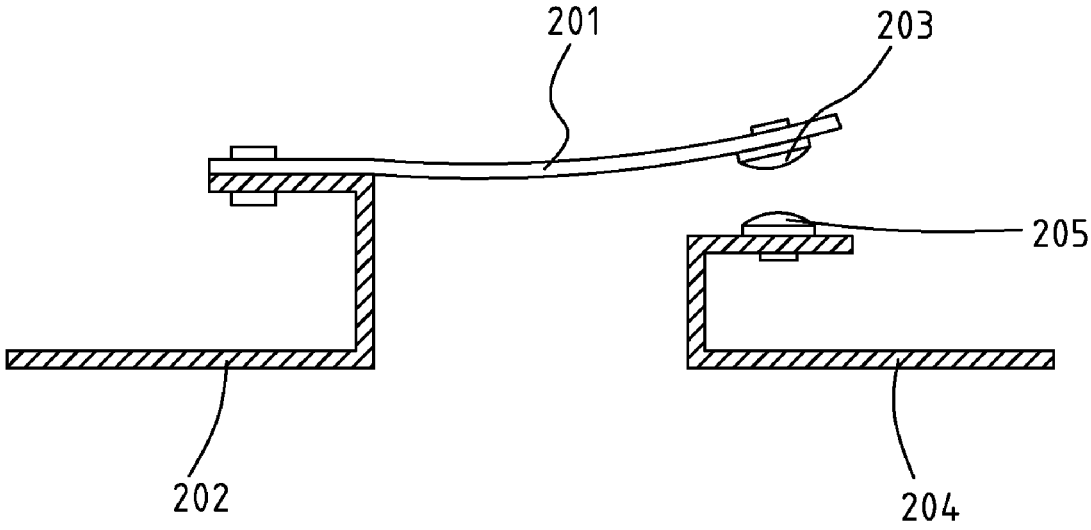
FIG. 2 (PRIOR ART)
FIG. 2 shows the conventional protection device in "OFF" status.
Figure 3:
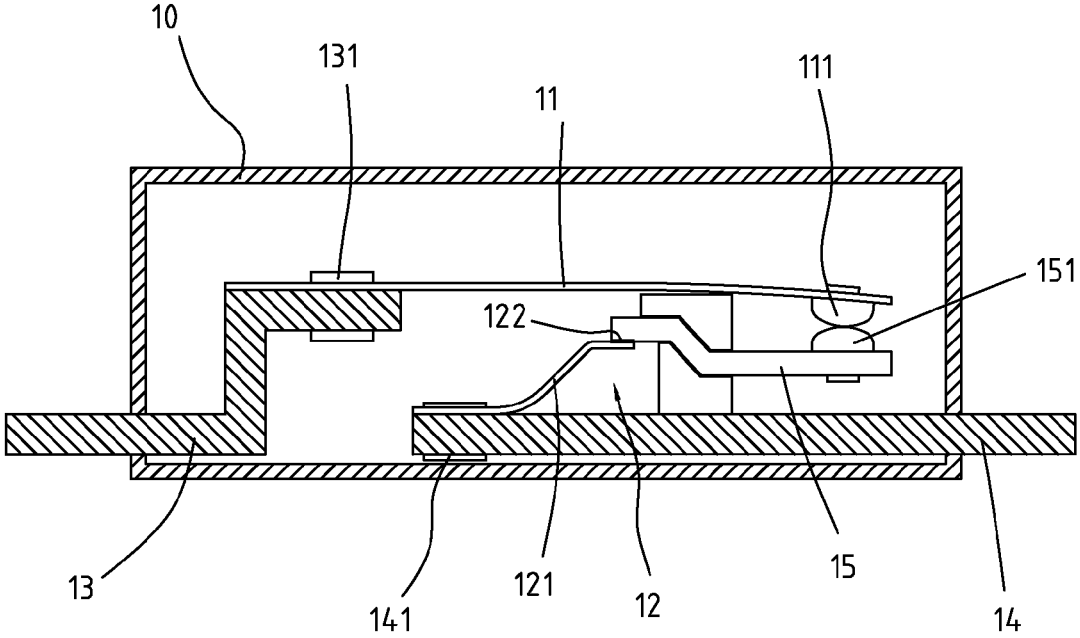
FIG. 3 shows the first embodiment of the protection device of the present invention is in "ON" status.
Figure 5:
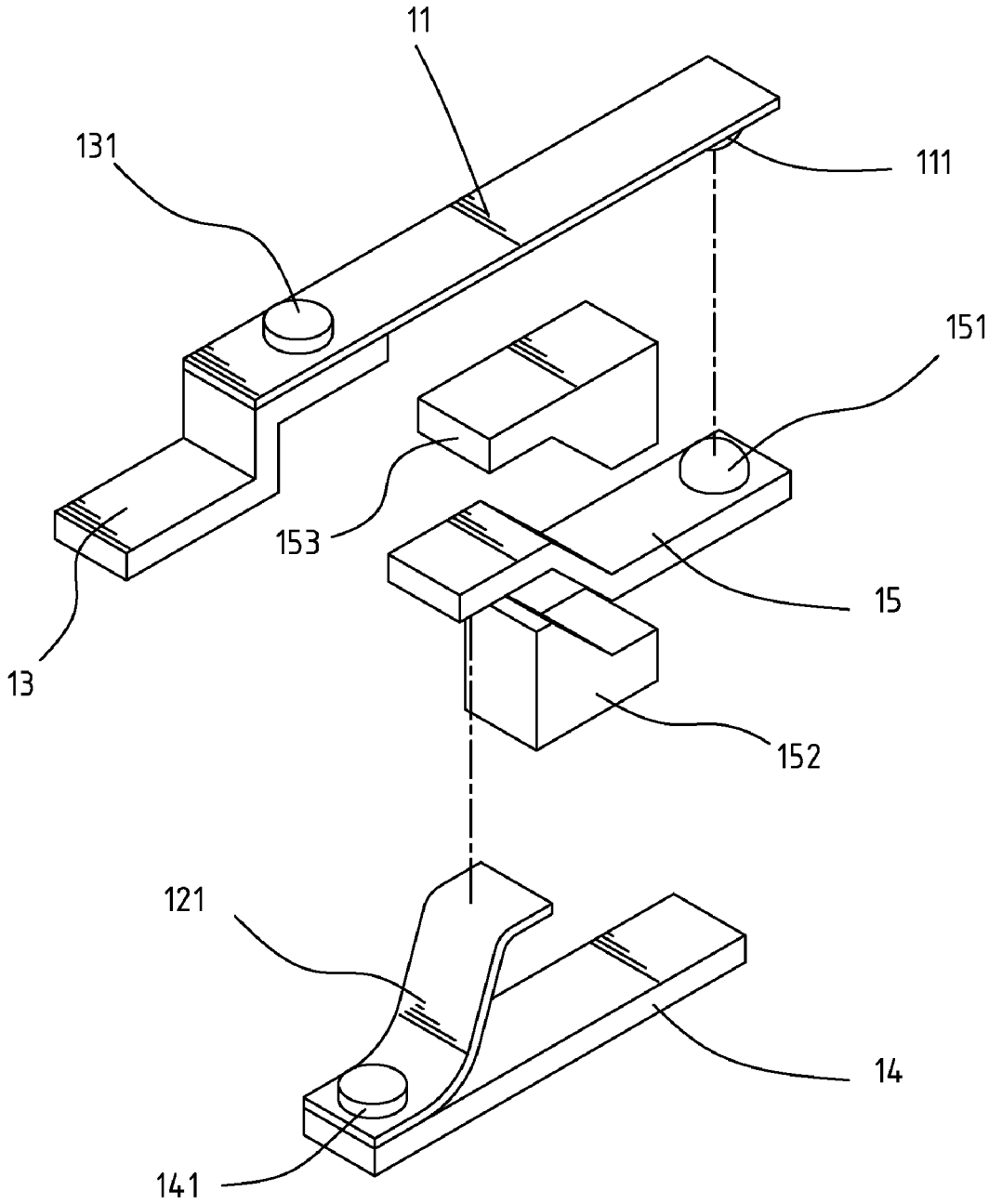
FIG. 5 shows an exploded view of the second protection device of the present invention.

Referring to FIGS. 3 and 5, the protection device of the present invention comprises a first protection device and a second protection device 12. The first protection device includes a curved bi-metallic plate 11 which has a first end fixed to a first terminal 13 by a rivet 131. A second end of the bi-metallic plate 11 is a free end which has a first contact point 111 connected to an underside thereof. A carrier 15 is clamped between two positioning members 152, 153 and has a second contact point 151 connected on a first end thereof. The second contact point 151 is located beneath the first contact point 111.

The second protection device 12 includes a contact plate 121 that has a first end connected to a second terminal 14 by another rivet 141 and a second end of the contact plate 121 is forced to be connected to a second end of the carrier 15 by a low melting point metal 122. The first and second terminals 13, 14 extend out from a box 10. The second end of the contact plate 121 tends to be separated from the carrier 15 when the low melting point metal 122 is not yet connected between the carrier 15 and the contact plate 121.

Figure 4:
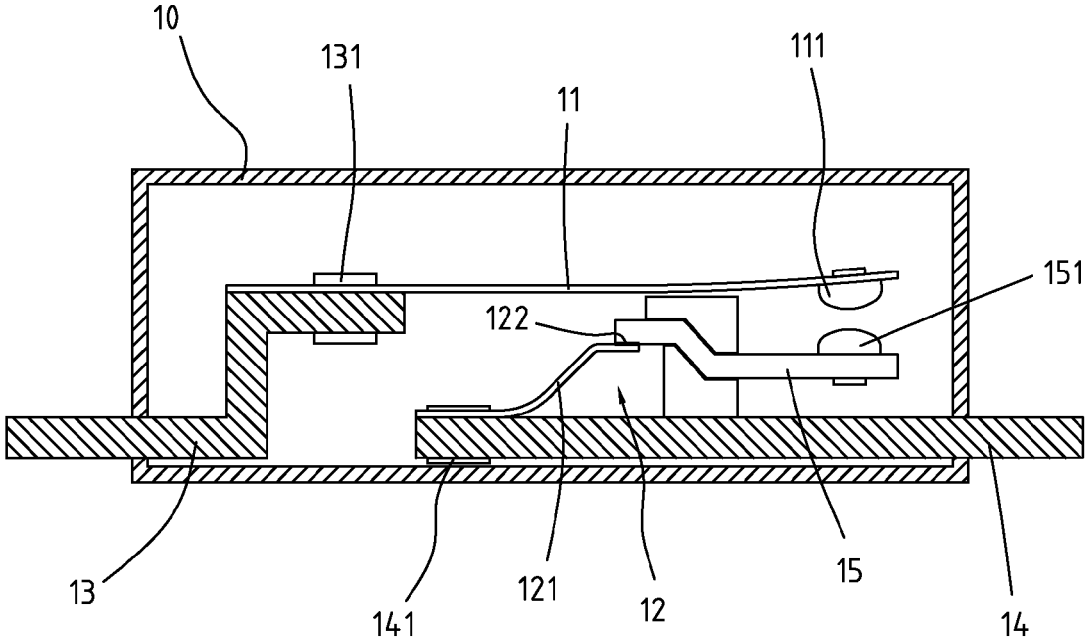
FIG. 4 shows that the first embodiment of the protection device of the present invention is in "OFF" status wherein the bi-metallic plate is bent upward.

As shown in FIG. 4, when the protection device is overloaded, the bi-metallic plate 11 is bent upward so that the first and second contact points 111, 151 are separated so as to cut off the circuit. This is the first stage of protection for the circuit.

Figure 6:
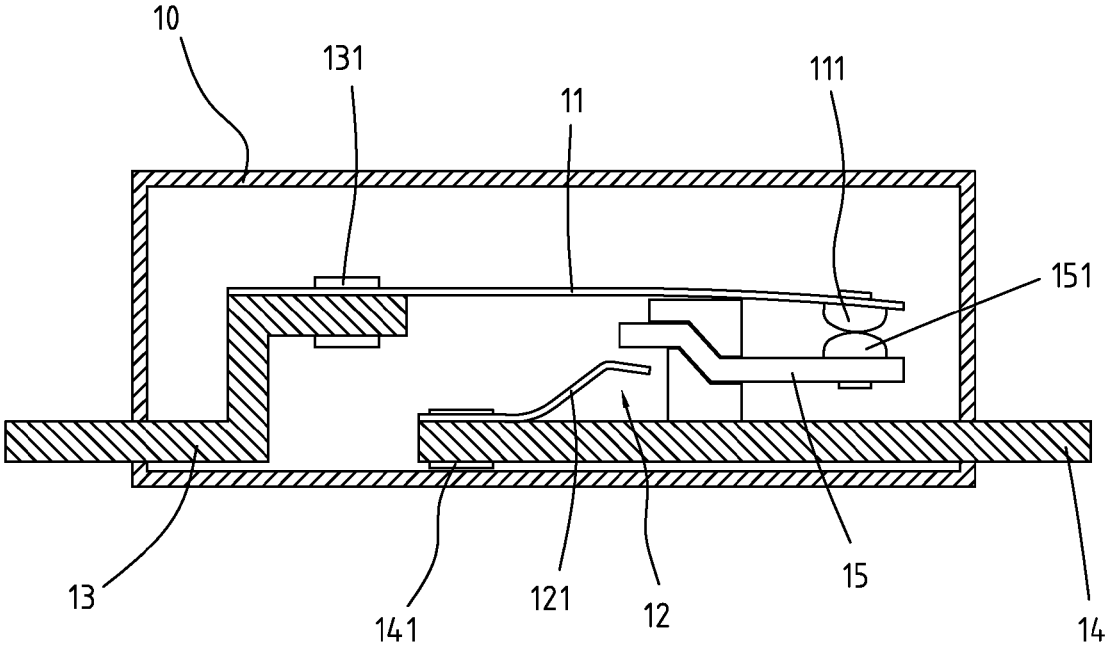
FIG. 6 shows the low melting point metal of the second protection device melts and the contact plate is separated from the carrier.

As shown in FIG. 6, if the bi-metallic plate 11 is not bent as expected when the protection device is overloaded, the low melting point metal 122 melts due to the temperature and, according to the nature of the contact plate 121, the second end of the contact plate 121 is separated from the carrier 15 to cut off the circuit.

Therefore, there are two protection devices to ensure that the circuit is cut off when the protection device is overloaded.

Figure 7:
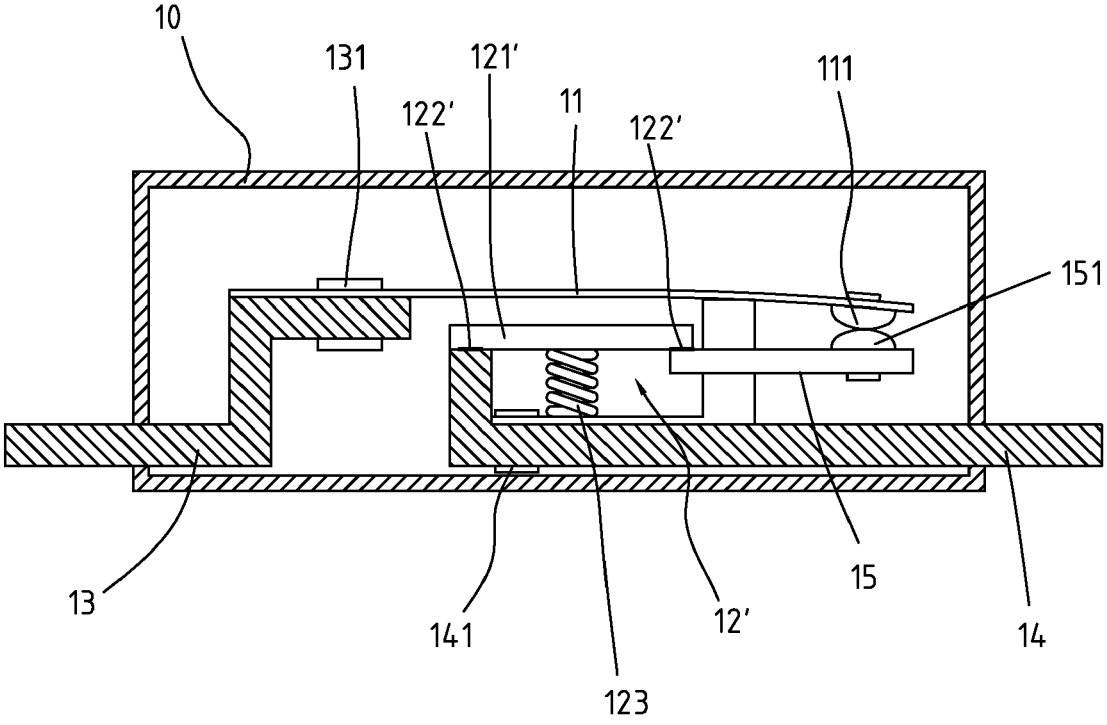
FIG. 7 shows another embodiment of the second protection device of the present invention.
Figure 8:
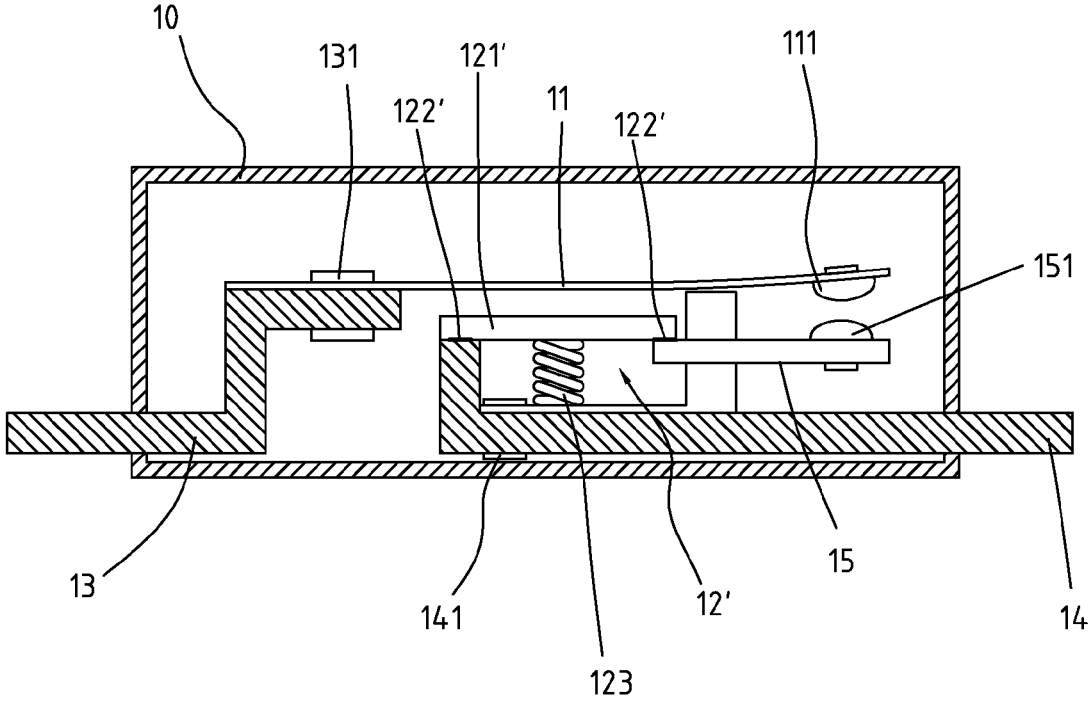
FIG. 8 shows that the bi-metallic plate is bent upward while the second protection device of the present invention is not yet activated.
Figure 9:
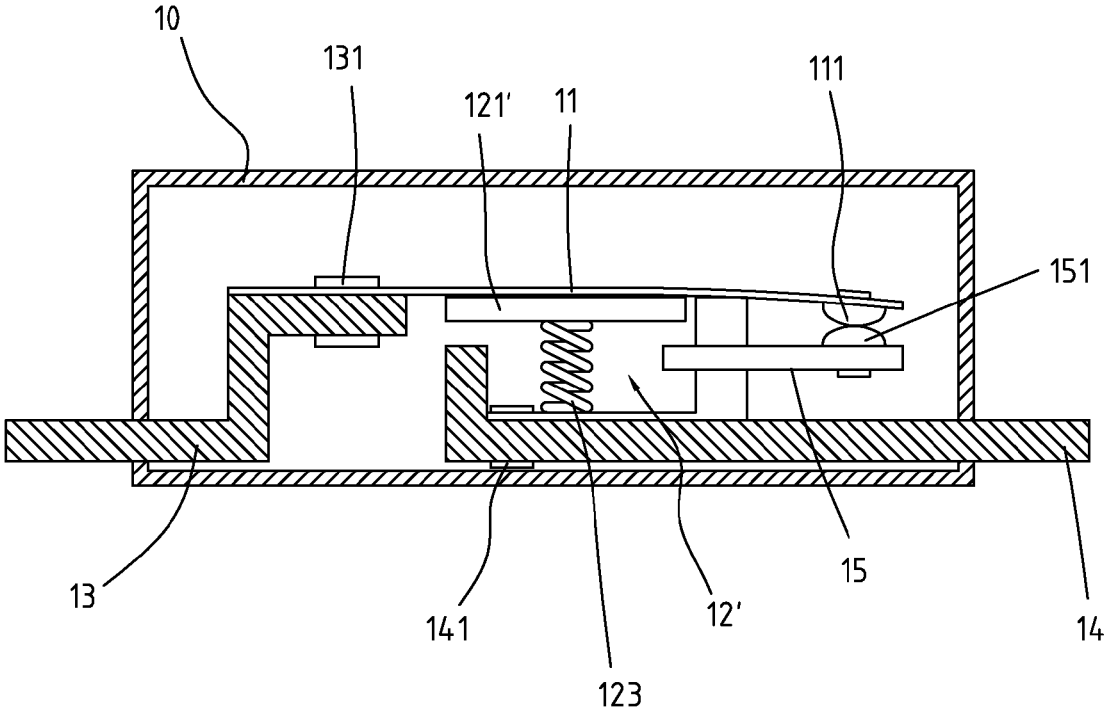
FIG. 9 shows that the contact plate of the second embodiment of the present invention is in "OFF" status.

As shown in FIG. 7 which shows another embodiment of the second protection device, wherein the second terminal 14 includes an upward portion and a spring 123 is connected between the second terminal 14 and the contact plate 121'. Low melting point material 122' is used to connect the two ends of the contact plate 11, the upward portion of the second terminal 14 and the carrier 15. When the protection device is overloaded, as shown in FIG. 8, the bi-metallic plate 11 is bent upward so that the first and second contact points 111, 151 are separated so as to cut off the circuit. If the bi-metallic plate 11 is not bent as expected, the low melting point material 122' melts so that the spring 123 pushes the contact plate 121' away from the carrier 15 and the upward portion of the second terminal 14 as shown in FIG. 9.

While we have shown and described the embodiment in accordance with the present invention, it should be clear to those skilled in the art that further embodiments may be made without departing from the scope of the present invention.

What is claimed is:

1. A protection device comprising:

a bi-metallic plate having a first end fixed to a first terminal and a second end of the bi-metallic plate being a free end which has a first contact point connected to an underside thereof;

a carrier having a second contact point connected on a first end thereof and the second contact point located beneath the first contact point, the carrier being clamped between two positioning members with the first end of the carrier and a second end of the carrier extending out respectively on two opposite sides of the positioning members; and a contact plate having a first end being in contact with a second terminal and a second end of the contact plate being forced to be connected to the second end of the carrier by a low melting point metal, the low melting point metal melting to separate the second end of the contact plate and the carrier when the protection device is overloaded.

2. The device as claimed in claim 1, wherein the bi-metallic plate is a curved plate.

3. The device as claimed in claim 1, wherein a spring is connected between the second terminal and the contact plate which pushes the contact plate away from the carrier when the low melting point metal melts.

* * * * *